US011325127B2

(12) United States Patent
Kim et al.

(10) Patent No.: US 11,325,127 B2
(45) Date of Patent: May 10, 2022

(54) METHODS FOR FLUID MANIPULATION BY ELECTRODEWETTING

(71) Applicant: THE REGENTS OF THE UNIVERSITY OF CALIFORNIA, Oakland, CA (US)

(72) Inventors: Chang-Jin Kim, Beverly Hills, CA (US); Jia Li, Los Angeles, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 965 days.

(21) Appl. No.: 16/071,218

(22) PCT Filed: Jan. 19, 2017

(86) PCT No.: PCT/US2017/014073

§ 371 (c)(1),
(2) Date: Jul. 19, 2018

(87) PCT Pub. No.: WO2017/127505

PCT Pub. Date: Jul. 27, 2017

(65) Prior Publication Data

US 2020/0298238 A1 Sep. 24, 2020

Related U.S. Application Data

(60) Provisional application No. 62/281,013, filed on Jan. 20, 2016.

(51) Int. Cl.
*B01L 3/00* (2006.01)
*B01F 13/00* (2006.01)

(52) U.S. Cl.
CPC .... *B01L 3/502792* (2013.01); *B01F 13/0076* (2013.01); *B01L 2200/0673* (2013.01); *B01L 2300/165* (2013.01); *B01L 2400/0427* (2013.01)

(58) Field of Classification Search
None
See application file for complete search history.

(56) References Cited

U.S. PATENT DOCUMENTS 6,884,693 B2 4/2005 Yi
7,439,014 B2 10/2008 Pamula et al.
7,458,661 B2 12/2008 Kim et al.
(Continued)

FOREIGN PATENT DOCUMENTS

WO WO 2013006312 A2 1/2013
WO WO 2013006312 A3 1/2013
WO WO 2015/031849 A1 3/2015

OTHER PUBLICATIONS

W. C. Nelson, ("EWOD microfluidic chips for applications: fundamentals of actuation, extensional rheometry, on-chip heating, and monolithic fabrication", University of California, Los Angeles, 193 pages (Year: 2011).*

(Continued)

*Primary Examiner* — J. Christopher Ball
(74) *Attorney, Agent, or Firm* — Vista IP Law Group LLP

(57) ABSTRACT

A method of fluid manipulation involves applying electric signals at one or more electrodes located on or adjacent to a surface in contact with a liquid that contains a surfactant. The electric field generated by the electric signals (e.g., biasing voltage) applied to the electrodes makes the liquid less wetting on the surface than the natural state and can be used to move or modify the shape of the liquid droplet placed on the surface. One embodiment makes a liquid dewet locally on a surface by applying electric signals locally on the surface so that the liquid can be electrically manipulated on a hydrophilic surface.

16 Claims, 13 Drawing Sheets

(56) References Cited

U.S. PATENT DOCUMENTS

| | | | |
|---|---|---|---|
| 8,349,276 | B2 | 1/2013 | Pamula et al. |
| 8,388,909 | B2 | 3/2013 | Pollack et al. |
| 8,481,125 | B2 | 7/2013 | Yi et al. |
| 8,883,014 | B2 | 11/2014 | Nelson et al. |
| 8,940,147 | B1 * | 1/2015 | Bartsch ..... B01L 3/502792 204/601 |
| 2007/0023292 | A1 | 2/2007 | Kim et al. |
| 2010/0032293 | A1 | 2/2010 | Pollack et al. |
| 2010/0096266 | A1 | 4/2010 | Kim et al. |
| 2010/0236929 | A1 | 9/2010 | Pollack et al. |
| 2011/0272575 | A1 | 11/2011 | Kim et al. |
| 2012/0264932 | A1 | 10/2012 | Van Dam et al. |
| 2014/0045712 | A1 | 2/2014 | Link et al. |
| 2014/0246319 | A1 | 9/2014 | Winger |
| 2014/0295572 | A1 | 10/2014 | Fraden et al. |

OTHER PUBLICATIONS

Huang, Lian-Xin et al., Evaluation of Anodic TA2O5 as the Dielectric Layer for EWOD Devices, MEMS 2012, Paris, France, Jan. 29-Feb. 2, 2012, pp. 428-431.

Kim, C.J., Chapter 305: Electrowetting, Encyclopedia of Nanotechnology,Springer-Veriag, 2012, Part 6, pp. 783-789.

Lu, Hsiang-Wei et al., A study of EWOD-driven droplets by PIV investigation, Lab Chip, 2008, 8, 456-461.

Nelson, Wyatt C. et al, Monolithic Fabrication of EWOD Chips for Picoliter Droplets, Journal of Microelectromechanical Systems, vol. 20, No. 6, Dec. 2011, pp. 1419-1427.

Nelson, Wyatt C. et al., Droplet Actuation by Electrowetting-on-Dielectric (EWOD): A Review, Journal of Adhesion Science and Technology 26 (2012) 1747-1771.

PCT International Search Report for PCT/US2017/014073, Applicant: The Regents of the University of California, Form PCT/ISA/210 and 220, dated Apr. 14, 2017 (3pages).

PCT Written Opinion of the International Search Authority for PCT/US2017/014073, Applicant: The Regents of the University of California, Form PCT/ISA/237, dated Apr. 14, 2017 (5pages).

PCT International Preliminary Report on Patentability (Chapter I of the Patent Cooperation Treaty) for PCT/US2017/014073, Applicant: The Regents of the University of California,Form PCT/IB/326 and 373, dated Aug. 2, 2018 (7pages).

The extended European search report dated Nov. 13, 2018 for European Patent Application No. 17741897.7, Applicant: The Regents of the University of California (8 pages).

Communication pursuant to Rule 70(2) and 70a(2) EPC dated Nov. 30, 2018 for European Patent Application No. 17741897.7, Applicant: The Regents of the University of California (1page).

Reply to communication pursuant to Article 94(3) EPC dated Sep. 23, 2020 in European Patent Application No. EP17741897.7, (3 pages).

Li, Jia et al., Ionic-surfactant-mediated electro-dewetting for digital microfluidics, Aug. 2, 2019, vol. 572, Nature, 507.

Response to extended European search report dated Jan. 13, 2020 in European Patent Application No. EP17741897.7, (26 pages).

Communication pursuant to Article 94(3) EPC dated Mar. 19, 2020 in European Patent Application No. EP17741897.7, (3 pages).

* cited by examiner

METHODS FOR FLUID MANIPULATION BY ELECTRODEWETTING

RELATED APPLICATION

This Application is a U.S. National Stage filing under 35 U.S.C. § 371 of International Application No. PCT/US2017/014073, filed Jan. 19, 2017, which claims priority to U.S. Provisional Patent Application No. 62/281,013 filed on Jan. 20, 2016, which is hereby incorporated by reference. Priority is claimed pursuant to 35 U.S.C. §§ 119, 371 and any other applicable statute.

TECHNICAL FIELD

The technical field generally relates to methods and devices used to manipulate fluids and more specifically to methods and devices that utilize the effect of an applied electrical field that makes a liquid less wetting on a surface than the natural state.

BACKGROUND

Electrowetting is a well-known effect in which an electric field applied between a liquid and a substrate makes the liquid more wetting on the surface than the natural state. The effect of electrowetting can be used to manipulate (e.g., move, divide, change shape) fluids by applying a series of spatially configured electrical fields on a substrate to increase the surface wettability following the spatial configurations in a sequence. The electrowetting effect is most typically used with electrowetting-on-dielectric (EWOD) devices, where the electrodes are covered with a dielectric layer. Since most reliable dielectric materials are hydrophilic but electrowetting is most effective on a hydrophobic surface, most EWOD devices require a hydrophobic topcoat that is interposed between the surface of a substrate and the fluid.

A typical EWOD device includes a substrate with electrodes patterned on it and a dielectric layer covering the electrodes. The dielectric layer, in turn, is covered with a thin layer of hydrophobic topcoat, so that water (or another fluid) beads on the topcoat surface in its natural (i.e., hydrophobic) state and wets the surface when an electric field is applied between the fluid and the electrode. While needed for effective EWOD, the use of a hydrophobic topcoat leads to several important difficulties and disadvantages. First, most materials, whether natural or engineered, are hydrophilic. Polymers tend to have a relatively low surface energy and are relatively less wettable, but only a small number of them, such as PTFE (Teflon®, Cytop®, etc.), are hydrophobic enough to render effective EWOD devices. Second, the strong hydrophobic materials come with a low surface energy, making it difficult to coat them on another material. The poor adhesion is an especially precarious problem, because the most typical failure mechanism of EWOD devices is the electrolysis of the liquid during EWOD actuation. The electrolysis is known to damage (e.g., peeling off) the hydrophobic topcoat, most often destroying the EWOD device permanently. When an EWOD device survives without the electrolysis, the next most common failure mode is electric charging. Strong hydrophobic materials, such as PTFE, are known to trap electric charges easily and for a long period of time. After lengthy or repeated application of electric potential, electric charges are imbedded in the topcoat, shielding the electric field and diminishing the electrowetting effect.

Yet another disadvantage to EWOD devices is that while almost all materials are fouled to some extent by biological elements, hydrophobic materials are especially vulnerable to biofouling. This problem is significant because major utilities of EWOD devices are in biomedical applications. Finally, the coating of a thin material is an extra step in the fabrication of the EWOD devices. This cost is significant especially if the EWOD devices are to be disposable.

SUMMARY

In the invention, fluid manipulation is accomplished by a different mechanism than electrowetting, namely, applying an electric field between a liquid and a substrate in contact with the liquid that makes the liquid less wetting (i.e., dewetting or repelling) on a surface than the natural state—the effect named herein as electrodewetting or electrorepelling. Electrodewetting is achieved, in part, due to the presence of surfactant molecules that are mobile in response to applied electrical field. The electrodewetting effect is in stark contrast to the electrowetting effect described above, for which an electric field makes a liquid more wetting on a surface than the natural state. Not only is the effect opposite, the mechanism of the electrodewetting is fundamentally different than the electrowetting mechanism. While electrowetting is an apparent decrease of contact angle by the electrostatic attraction between the fluid and the substrate, electrodewetting is a real increase of contact angle by electrostatically coating the substrate surface with a surfactant. On the other hand, however, while the electrowetting-based contact angle change is controlled directly by applied voltages, electrodewetting-based contact angle change is not necessarily so. For example, if the attracted surfactant molecules remain on the surface after removing the electric field, the contact angle will remain increased even with no voltage applied. In other words, the contact angle may exhibit multiple values for a given voltage. Furthermore, it is not well understood what happens to the attracted surfactant molecules after the surrounding fluid, i.e., the fluid not containing surfactant molecules that are mobile in an electric field, covers the surfactant-coated area during fluid manipulations. Because of these complications, which the electrowetting-based fluid manipulations did not have, it has not been obvious or expected that the electrodewetting effect could be utilized to manipulate fluids like the electrowetting did. A typical practice with electrodewetting would be to make a liquid locally dewet on a hydrophilic surface by applying electric voltages locally on the surface. The disclosed electrodewetting-based manipulation method brings about new utilities not possible with the existing electrowetting-based method, such as the use of common materials for the surface, such as glass, instead of only a hydrophobic material. Most materials, whether natural or artificial, are hydrophilic (i.e., water contact angle smaller than 90°). Hydrophobic materials (i.e., water contact angle larger than 90°) are rare, and they tend to degrade particularly when subjected to electric fields and electrochemical activities in EWOD devices.

The disclosed fluidic manipulation by electrodewetting effect can achieve what much of the well-accepted electrowetting effect (especially EWOD) does but without facing the main limitations of the latter. The main advantage of the electrodewetting-based microfluidics over the electrowetting-based microfluidics is its ability to use hydrophilic surfaces in contact with liquids. The use of a hydrophilic surface is a major advantage, considering most of the main shortcomings of the EWOD-based microfluidics stem from its necessary use of a hydrophobic topcoat.

Without any topcoat, electrodewetting-based microfluidic devices are simpler to manufacture than EWOD devices and are free of the above listed problems. For example, an electrodewetting device can have a $SiO_2$ surface, as experimentally verified in FIGS. 4A and 4B. The main ingredient of glass, $SiO_2$ is the most common material used in biology and chemistry laboratories and medical practice as well as optical devices. Electrodewetting devices can be used for most of the applications EWOD devices are employed for: biomedical instruments (e.g., sample preparation, cell cultivation, on-chip clinical diagnoses, on-chip synthesis), optical devices (e.g., variable lens, electronic paper, video displays), electronic devices (e.g., variable capacitor, electronic switch), mechanical instruments (e.g., miniature rheometer), and so on.

DETAILED DESCRIPTION OF ILLUSTRATED EMBODIMENTS

Figure 1A:
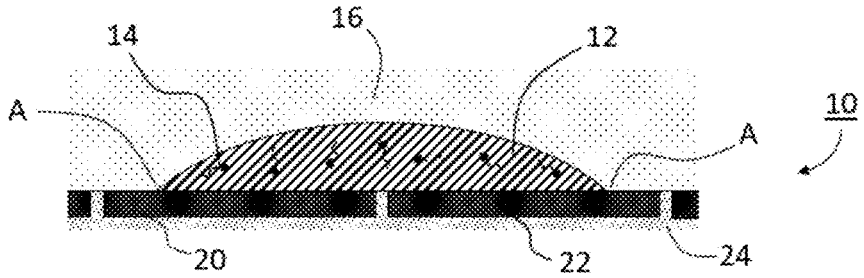
FIG. 1A illustrates one embodiment of a device that is used to move a liquid droplet containing a surfactant in an immiscible fluid on a surface using the electrodewetting effect.

FIG. 1A shows a basic device 10 configuration to move a liquid droplet 12 containing a surfactant 14 in an immiscible fluid 16 on a surface using the electrodewetting effect. The liquid droplet 12 contains surfactant molecules 14 that are mobile in response to an electric field that is applied to the liquid, while the immiscible fluid 16 contains no surfactant 14 or only surfactants that are not mobile under an electric field in the immiscible fluid 16 (e.g., non-ionic surfactant molecules). In an immiscible fluid 16 (e.g., air, oil), a droplet 12 of liquid (e.g., water) contains surfactant molecules 14 and sits on a surface of electrodes 20 and 22 that are located on a substrate 24. Note that only the surfactant molecules 14 that are mobile under an electric field are illustrated in the FIGS. Those surfactant molecules that are not mobile are not illustrated and not discussed even if they are present. Although FIG. 1A shows an embodiment where the liquid droplet 12 is fully immersed in the immiscible fluid 16, it also includes an embodiment where the immiscible fluid 16 is a thin layer including a layer thinner than the height of the liquid droplet 12, such as the case of a substrate 24 impregnated with immiscible fluid 16. The surfactant molecules 14 may be cationic surfactant such as cetyltrimethylammonium bromide (CTAB), tetradecyltrimethylammonium bromide (TTAB), and dodecyl trimethylammonium bromide (DTAB), or anionic surfactant such as 1-hexadecanesulfonic acid sodium salt (HDSAS), sodium tetradecyl sulfate (STS), sodium dodecyl sulfate (SDS), and sodium decyl sulfate (S10S). The composition of the counter-ion of these surfactants can be changed as well. For example, in DTAB, the bromide ion can be altered by other ions such as chloride; in SDS, the sodium ion can be altered by other ions such as potassium ion. The concentration of the surfactant should be below its critical micelle concentration (CMC), which is the concentration of a surfactant above which the surfactant molecules form micelles.

Figure 1B:
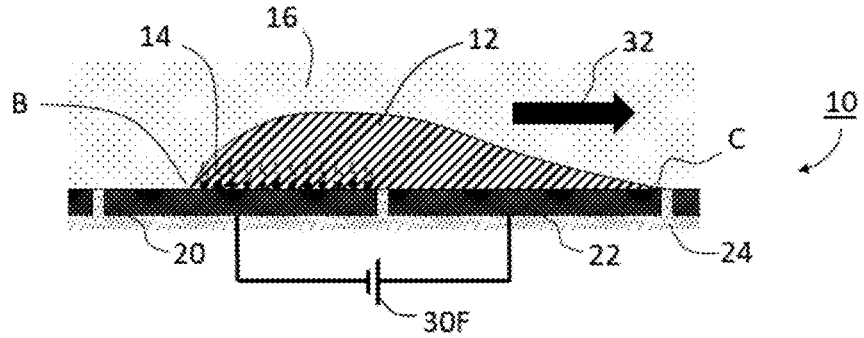
FIG. 1B illustrates a first bias voltage being applied between two electrodes of the device of FIG. 1A to move the droplet in one direction.
Figure 1C:
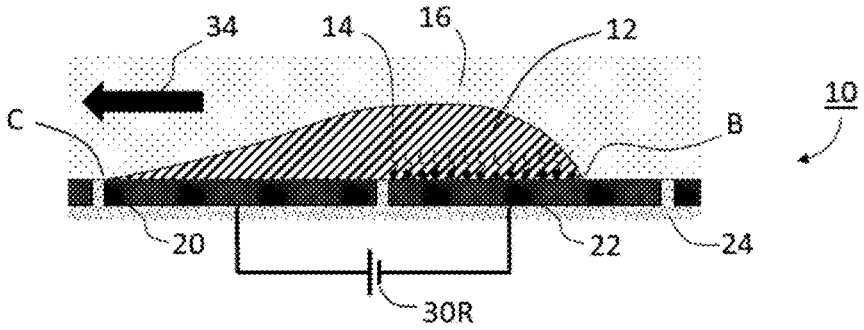
FIG. 1C illustrates a second bias voltage (reversal of FIG. 1B) being applied between two electrodes of the device of FIG. 1A to move the droplet in the reverse direction.

When a bias voltage 30F is applied as the electrical signal between electrodes 20 and 22 as shown in FIG. 1B, electrode 20 attracts surfactant molecules 14 to its surface thus increasing the contact angle of the droplet 12 of liquid from the original angle A to an increased angle B on the electrode 20 (and consequently making the liquid droplet 12 less wetting at electrode 20 as compared to its natural wetting state). At the same time, electrode 22 repels surfactant molecules 14 thus decreasing the contact angle of the liquid droplet 12 from the original angle A to a decreased angle C on the electrode 22. As result, the droplet 12 moves from the less wetting electrode 20 toward the more wetting electrode 22. Arrow 32 shows the direction of movement of the droplet 12. In FIGS. 1B and 1C, surfactant molecules 14 are presumed to be cationic surfactant molecules. If an anionic surfactant is used, the droplet 12 would move in the reverse direction. If the bias voltage 30F is reversed to 30R as shown in FIG. 1C, the liquid droplet 12 would move in the reverse direction as shown with the arrow 34. Although a battery symbol is used to indicate the source of the biasing voltage in the FIGS. and described as a DC voltage source in the text, it should be appreciated that any source that provides necessary electric signals, either DC or AC, such as voltage source, current source, power supply, and their variations, including both manual and programmable sources may be used. Compared with DC, AC signals have their own advantages such as suppressing the bubble generation inside the droplet when actuated with a high voltage.

Figure 1D:
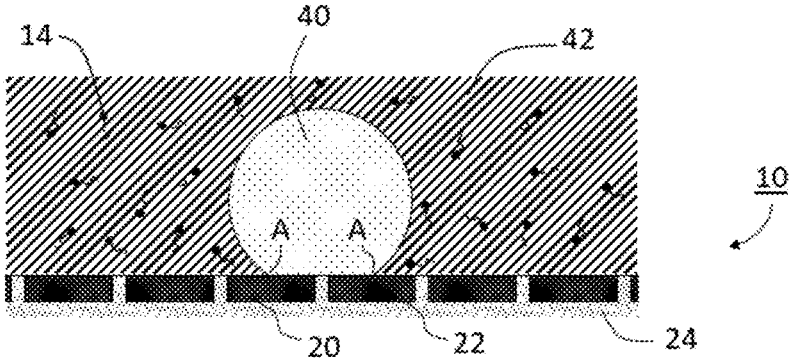
FIG. 1D illustrates one embodiment of a device that is used to move a droplet or bubble of an immiscible fluid in the liquid containing a surfactant on a surface using the electrodewetting effect.
Figure 1E:
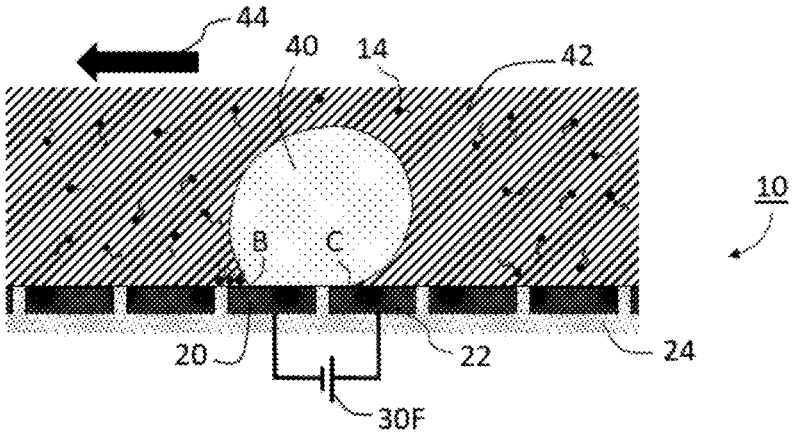
FIG. 1E illustrates a first bias voltage being applied between two electrodes of the device of FIG. 1D to move the droplet or bubble of an immiscible fluid in one direction.
Figure 1F:
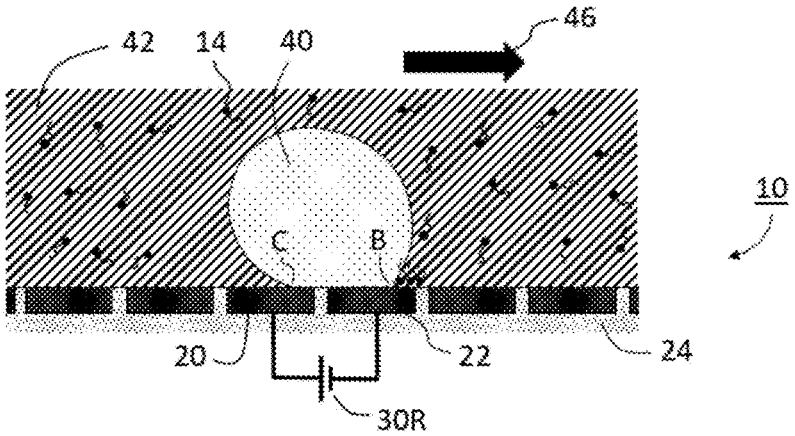
FIG. 1F illustrates a second bias voltage (reversal of FIG. 1B) being applied between two electrodes of the device of FIG. 1D to move the droplet or bubble of an immiscible fluid in the reverse direction.

Complementary to the embodiment illustrated in FIGS. 1A-1C, FIGS. 1D-1F show the same device 10 moving a droplet or bubble 40 of an immiscible fluid surrounded by a liquid 42 disposed on a surface using the electrodewetting effect. Note that the mobile surfactant molecules 14 are contained in liquid 42 outside the droplet or bubble 40. In particular, the liquid 42 contains surfactant molecules 14 that surround the droplet or bubble 42 that sits on a surface of electrodes 20 and 22 and substrate 24. When a bias voltage 30F (again, although drawn with a battery sign here for simplicity, the electric signal can be of any kind from any source) is applied between electrodes 20 and 22 as shown in FIG. 1E, electrode 20 attracts surfactant molecules 14 to its surface thus increasing the contact angle of liquid 42 from the original angle A to an increased angle B on the electrode 20. Note the contact angle is defined as the angle of the liquid (i.e., 12 in FIG. 1A or 42 in FIG. 1D) on surface in the immiscible fluid (i.e., 16 in FIG. 1A or 40 in FIG. 1D) to be consistent. At the same time, electrode 22 repels surfactant molecules 14 thus decreasing the contact angle of liquid 42 from the original angle A to a decreased angle C on the electrode 22. Because the surrounding liquid 14 wets the more wetting electrode 22 and dewets the less wetting electrode 20, the liquid 14 moves from the electrode 22 towards the electrode 20, carrying the droplet or bubble 40 with it. As result, the droplet or bubble 40 of the immiscible fluid moves from the electrode 22 towards the electrode 20 in a fashion complementary to FIGS. 1A-1C. Arrow 44 shows the direction of droplet movement. If the bias voltage is reversed to 30R as shown in FIG. 1F, the droplet 40 would move in the reverse direction as shown with the arrow 46. FIGS. 1D-F are presented here to show the complementary nature between the embodiment illustrated in FIGS. 1A-1C (i.e., a surfactant-containing liquid droplet surrounded by an immiscible fluid) and the embodiment illustrated in FIGS. 1D-1F (i.e., an immiscible fluid droplet or bubble surrounded by a surfactant-containing liquid). This complimentary nature between the surfactant-containing liquid and the surrounding immiscible fluid should be noted for all other devices described herein, even if not specifically disclosed.

Figure 2A:
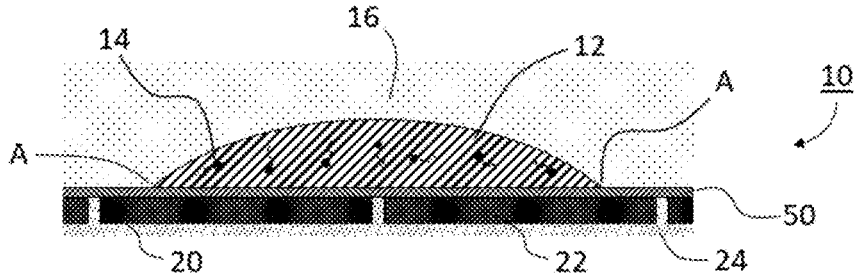
FIG. 2A illustrates one embodiment of a device that is used to move a liquid droplet on a surface using the electrodewetting effect. More specifically, in this embodiment a hydrophilic material is added on the electrodes and contacts the droplets.
Figure 2B:
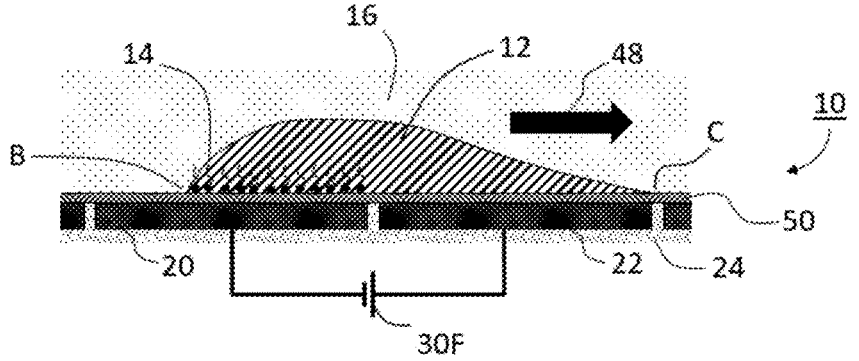
FIG. 2B illustrates a first bias voltage being applied between two electrodes of the device of FIG. 2A to move the droplet in one direction.

FIG. 2A shows a device 10 configuration that is the same as illustrated in FIG. 1A except a layer 50 (typically <10 microns) of a non-conductive material (e.g., silicon nitride, lightly doped silicon, or native silicon oxide) is added on the electrodes 20 and 22. This layer 50 typically has a relatively high electrical resistance, thus serving as a dielectric (i.e., electrically insulating) or has some degree of electrical leakage thus serving as a leaky dielectric (i.e., electrically resistive layer). When the layer 50 operates as dielectric it provides an electric insulation to prevent potential electric current flow between the liquid 12 and any of the electrodes 20 and 22, so that relatively large voltages can be used compared with the configurations of FIGS. 1B and 1C. When the layer 50 is operating as a leaky dielectric, it allows some electric current to flow between the liquid 12 and any of the electrodes 20 and 22. Compared with FIG. 1A configuration, the layer 50 in FIGS. 2A-2C limits current and improves the reversibility of the device 10 by providing an electric resistance. Note the resistance of the layer 50 is determined by the thickness as well as the resistivity of the material, suggesting numerous combinations of thicknesses and materials. Since the embodiment of FIG. 1A may be considered to be a special case (i.e., layer 50 having zero resistance) of FIG. 2A it should be understood that any reference to either the embodiment of FIG. 1A or FIG. 2A encompasses both embodiments (i.e., with or without layer 50). In FIG. 2B, when a bias voltage 30F is applied between electrodes 20 and 22, electrode 20 attracts surfactant molecules 14 to its nearest surface thus increasing the contact angle from A (FIG. 2A) to B (FIG. 2B) on the surface above the electrode 20 (and consequently making the liquid droplet 12 less wetting at electrode 20 as compared to its natural state). At the same time, electrode 22 repels surfactant molecules 14 thus decreasing the local contact angle from A (FIG. 2A) to C (FIG. 2B) on the surface above the electrode 22. As result, the droplet moves from the less wetting electrode 20 toward the more wetting electrode 22. Arrow 48 shows the direction of droplet movement. If the bias voltage is reversed to 30R as shown in FIG. 2C, the droplet of liquid 12 would move in the reverse direction as shown with an arrow 49.

Droplet 12 is in contact with the electrodes 20 and 22 in FIG. 1A and the added layer 50 in FIG. 2A. Either on electrodes 20, 22 or layer 50, one may still tune the final hydrophilicity of the device surface by adding another optional thin (<0.1 micron) layer (not shown in the FIGS.) including a surfactant or doing a hydrophilic treatment such as piranha solution (a mixture of sulfuric acid $H_2SO_4$ and hydrogen peroxide $H_2O_2$) cleaning. As used herein, the term "hydrophilic," which conventionally means wettable to water, should further be interpreted to mean wettable to other liquids besides water when the liquid droplet 12 is not water. For example, most hydrophobic surfaces, i.e., dewettable to water, are lipophilic, i.e., wettable to oils. The electrodewetting methods may also work with hydrophobic surfaces if the surfactant-containing liquid (e.g., oil, solvent) wets the hydrophobic surface. Generally, the electrodewetting methods described herein will work when the contact angle of the liquid on the surface of interest is less than 45° and increases by more than 10° via surfactant absorption.

The basic electrode and surface configuration shown in FIGS. 1A-1F and 2A-2C can be expanded to other variations, as follows. FIGS. 3A-3E presents an electrode configuration that differs from the configuration of FIGS. 1A-1F and 2A-2C. A middle electrode 52 is added between the two electrodes 20 and 22. FIGS. 3B and 3C illustrate one way to move the liquid droplet 12. When a bias voltage 30F is applied between electrode 20 and the middle electrode 52 as shown in FIG. 3B, the electrode 20 attracts the surfactant molecules 14 to its near surface and thus increases the contact angle from A to B above the electrode 20. The contact angle on the surface above the unbiased electrode 22 remains essentially the same, keeping the contact angle A. The difference between the contact angles B and A induces the liquid droplet 12 to move to the direction of arrow 54 (from the less wettable electrode 20 toward the unbiased electrode 22). By applying the same bias voltage 31F between electrode 22 and the middle electrode 52 as shown in FIG. 3C in a mirror image of FIG. 3B, the liquid droplet 12 would move in the reverse direction as shown with an arrow 56. FIG. 3D illustrates another way to move the liquid droplet 12 by reversing the biasing voltage 30F of FIGS. 3B to 30R. When biasing voltage 30R is applied between the electrode 20 and the center electrode 52, the electrode 20 repels the surfactant molecules 14 from the surface above the electrode 20, decreasing the contact angle from A to C above electrode 20. The contact angle on the surface above the unbiased electrode 22 remains essentially the same, keeping the contact angle A (FIG. 3D). The liquid droplet 12 moves in the direction of arrow 56. By applying the same bias voltage 31R between the electrode 22 and the middle electrode 52 as shown in FIG. 3E in a mirror image of FIG. 3D, the liquid droplet 12 would move in the reverse direction as shown with arrow 54.

Figure 2C:
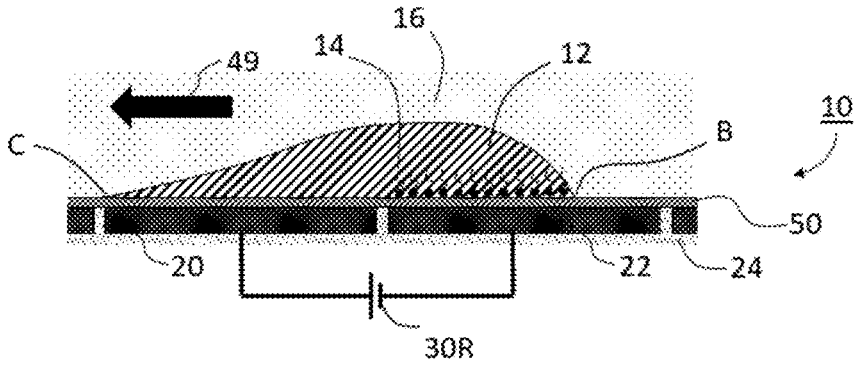
FIG. 2C illustrates a second bias voltage (reversal of FIG. 2B) being applied between two electrodes of the device of FIG. 2A to move the droplet in the reverse direction.
Figure 3A:
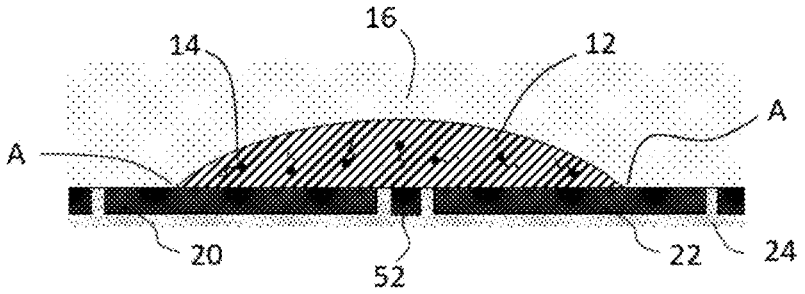
FIG. 3A illustrates another embodiment of a device that is used to move a liquid droplet on a surface using the electrodewetting effect.
Figure 3B:
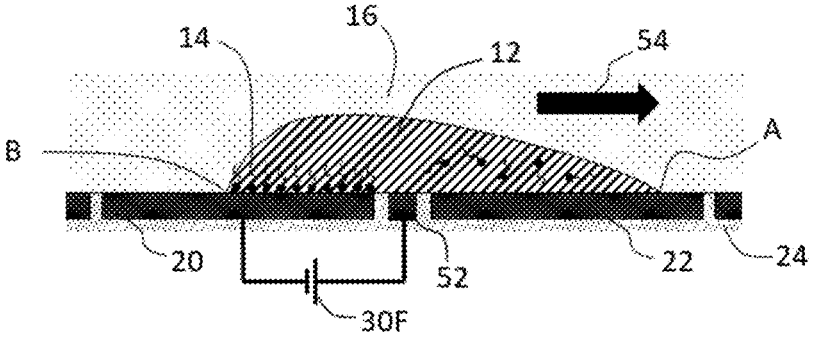
FIG. 3B illustrates a first bias voltage being applied between a middle electrode and one electrode of the device of FIG. 3A to move the droplet in one direction.
Figure 3C:
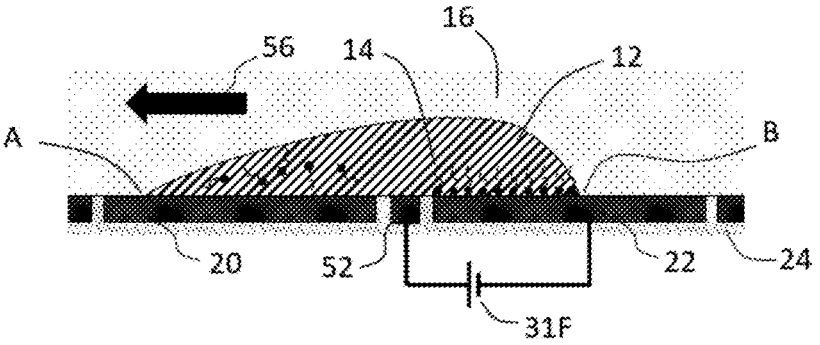
FIG. 3C illustrates a first bias voltage being applied between a middle electrode and the other electrode in a mirror image of FIG. 3B to move the droplet in the reverse direction.
Figure 3D:
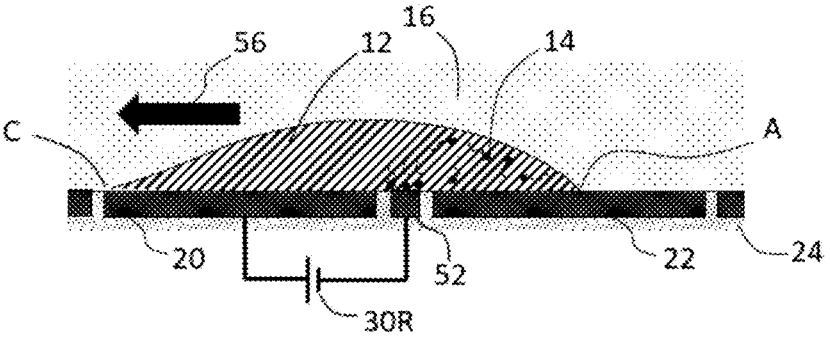
FIG. 3D illustrates a second bias voltage (reversal of FIG. 3B) being applied between a middle electrode and one electrode of the device of FIG. 3A, presenting another way to move the droplet as compared to FIG. 3B.
Figure 3E:
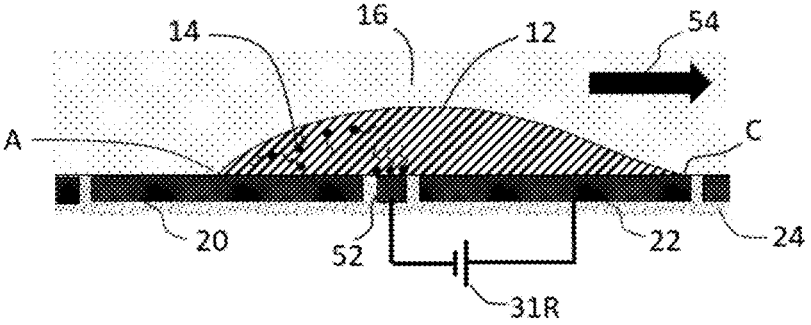
FIG. 3E illustrates a second bias voltage (reversal of FIG. 3C) being applied between a middle electrode and the other electrode in a mirror image of FIG. 3D, presenting another way to move the droplet as compared to FIG. 3C.
Figure 4A:
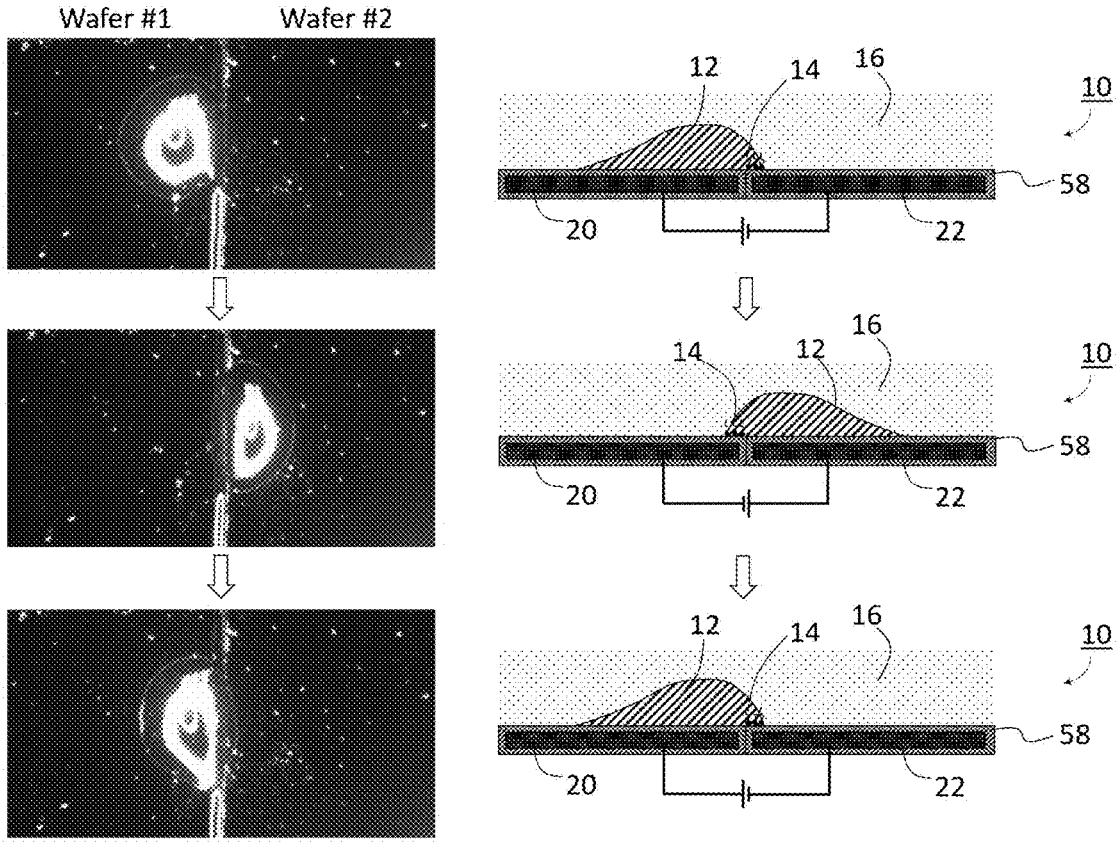
FIG. 4A illustrates a sequence of top-view photographs taken of a droplet moving between two dielectric-coated, electrically conductive substrates separated by a small gap after application of a biasing voltage (shown alongside corresponding cross-sectional drawings). This corresponds to the embodiments illustrated in FIGS. 2A-2C.
Figure 4B:
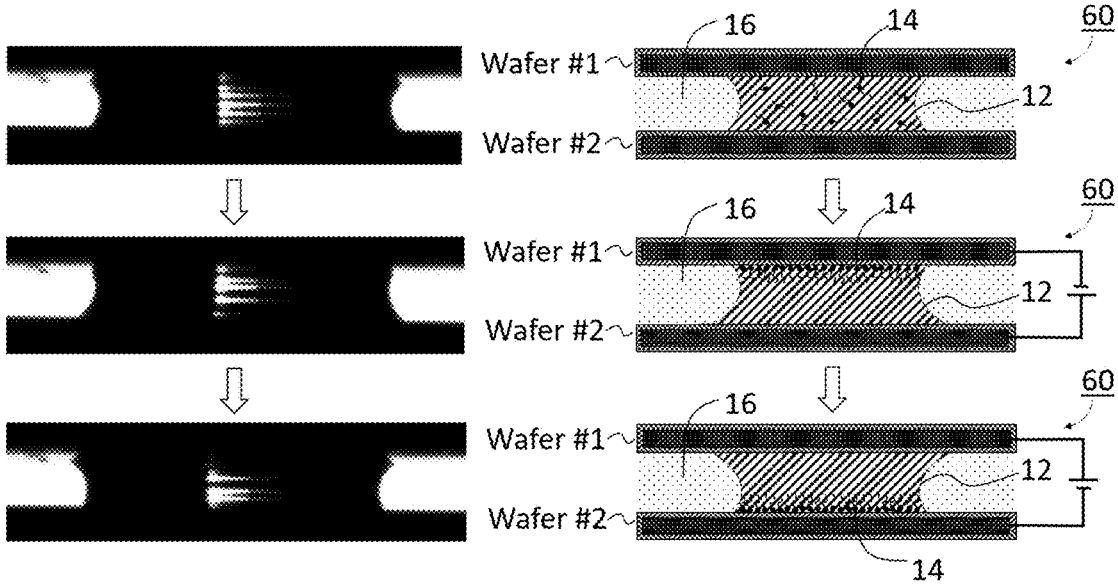
FIG. 4B illustrates a sequence of side-view photographs taken of a droplet squeezed and deforming between a dielectric-coated, electrically conductive substrate and another dielectric-coated, electrically conductive substrate separated by a space or gap after application of a biasing voltage between the two conductive substrates (shown alongside corresponding cross-sectional drawings).

FIG. 4A illustrates top down images of two adjacent electrodes 20, 22 used to manipulate a water droplet 12 as part of a proof-of-concept experiment, using the configuration of FIGS. 1A-1C and 2A-2C but more specifically FIGS. 2A-2C. Each image is accompanied by a corresponding cross-sectional figure on the right. Two pieces of electrically conductive silicon wafer, whose surfaces are electrically insulated with native silicon oxide layer 58, are placed next to each other with a minimal gap between the two. When a voltage bias 30F is applied between the two silicon pieces and reversed is polarity to 30R, the water droplet 12 on them was moved back and forth, verifying the invention. The voltage used in this experiment was 5 V in DC. The surfactant 14 used for this experiment was 0.2 mM/L DTAB. As another proof-of-concept experiment, FIG. 4B illustrates side-view images of an electrodewetting-based device 60 that produces shape changes in a water droplet 12 that is squeezed between two parallel plates of wafer #1 and wafer #2. A voltage bias 62F or 62R is applied between the two parallel plates.

Figure 5A:
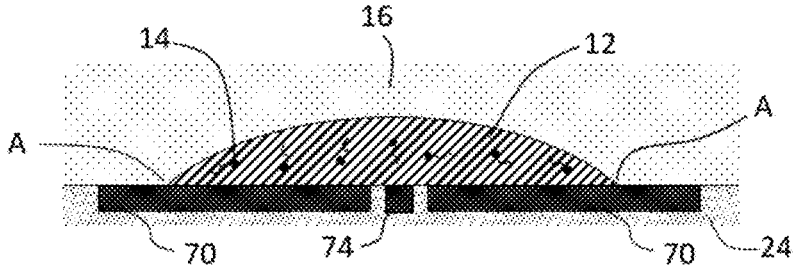
FIGS. 5A-5C illustrate one embodiment of an electrodewetting device that is used to change the shape of a droplet on a surface using the electrodewetting effect.
Figure 5B:
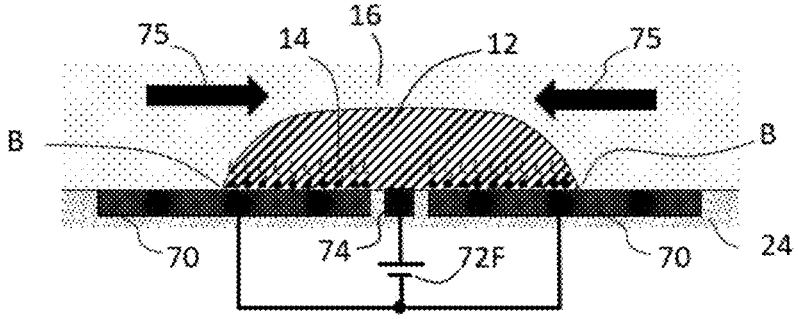
Figure 5C:
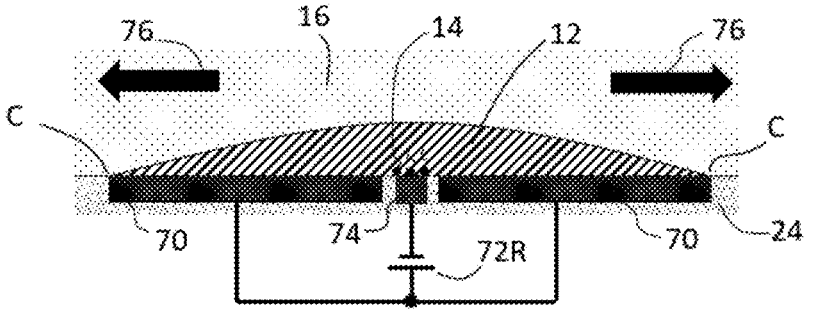

Fluid manipulation includes not only sliding or displacement of the fluid droplet 12 along the surface but also shape changing of the fluid droplet 12, either a liquid droplet or gas bubble. FIGS. 5A-5C illustrate one such example, using a configuration similar to FIGS. 3A-3E except that it employs a circular or donut shaped, unitary electrode 70 when viewed from top. In this embodiment, features identical to those illustrated in FIGS. 3A-3E include the same reference numbers. When a voltage bias 72F is applied between electrode 70 and the center electrode 74, as shown in FIG. 5B, the electrode 70 attracts the surfactant molecules 14 to its near surface and thus increases the contact angle from A of FIG. 5A to B, causing the liquid droplet 12 to bead up as seen in FIG. 5B with arrow 75. By reversing the bias voltage to 72R in FIG. 5C, the electrode 70 repels the surfactant molecules 14 from the surface above the electrode 70, thus decreasing the local contact angle to C as seen in FIG. 5C, causing the liquid droplet 12 to spread as seen in FIG. 5C with arrow 76. Although the droplet 12 shape manipulation is described here with only one electrode 70 and the center electrode 74 for simplicity, more electrodes may be used to achieve more sophisticated shape controls. For example, a donut shape electrode 70 may be divided into multiple concentric donuts (each with separate actuation control lines or circuitry) to control the droplet beading and spreading in multiple steps, or electrode 70 may be divided into more complex electrode patterns that are not necessarily axisymmetric.

Figure 6A:
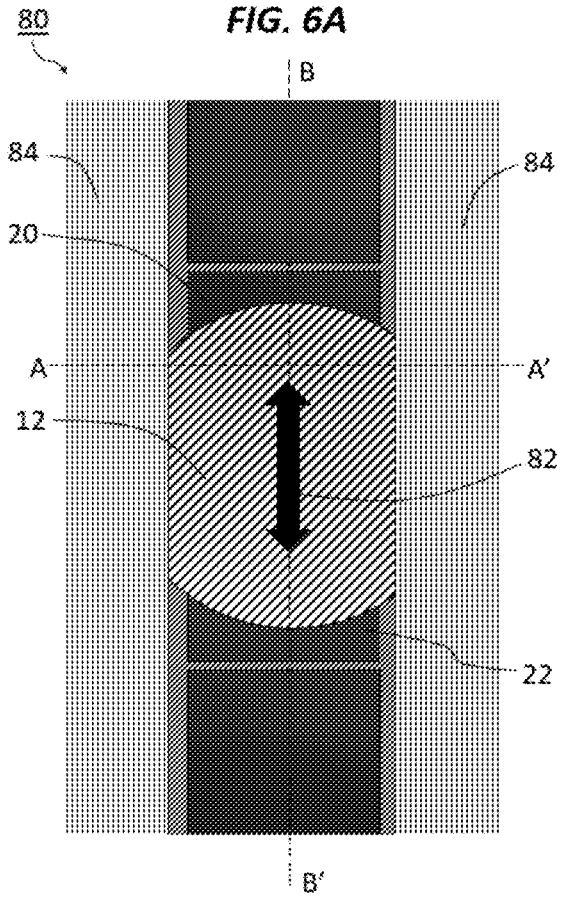
FIG. 6A illustrates a top view of an electrodewetting device that incorporates hydrophobic surfaces to guide droplet locations and movements.
Figure 6B:
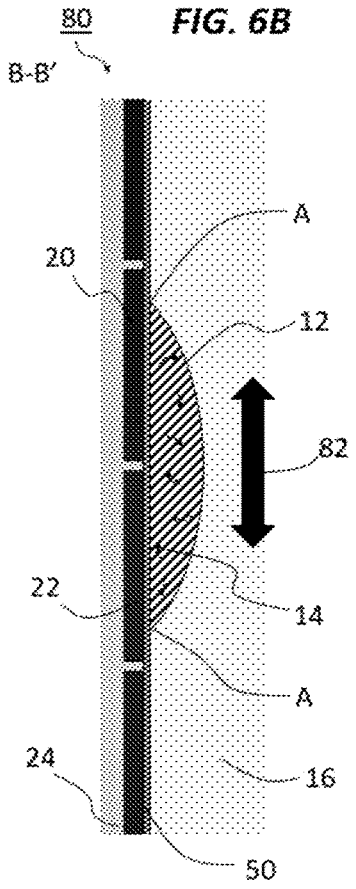
FIG. 6B illustrates a side, cross-sectional view of the device of FIG. 6A.
Figure 6C:
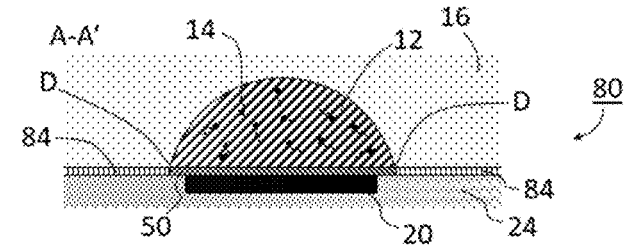
FIGS. 6C-6D illustrate front, cross-sectional views of the devices of FIG. 6A.
Figure 6D:
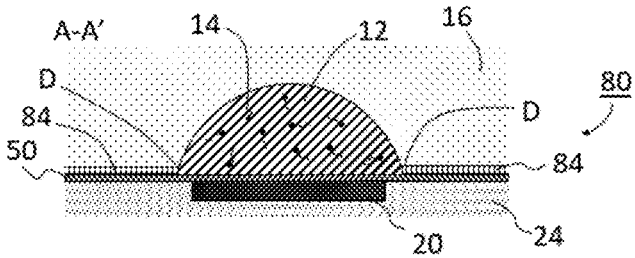
Figure 6E:
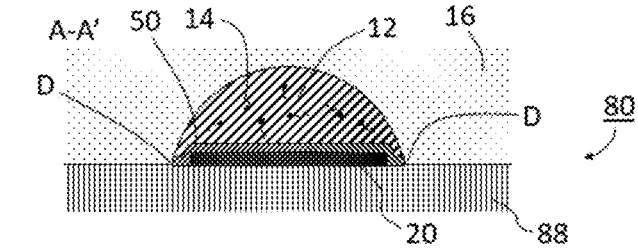
FIG. 6E illustrates a front, cross-sectional view of another alternative embodiment of the device.

FIGS. 6A-6E illustrate additional device 10 configurations expanded from FIGS. 2A-2C by introducing hydrophobic surfaces to enhance controlling or guide droplet movements in three different examples. FIGS. 6A-6C illustrate, respectively, the top view, cross-section viewed from side, and cross-section viewed from front of an electrodewetting device 80. As seen in FIGS. 6A and 6B, a droplet of liquid 12 on layer 50 can be moved along the direction of arrow 82 by the electrodewetting effect using the underlying electrodes 20 and 22. In FIG. 6C, contact angle D is large (e.g., larger than contact angle A in FIG. 6B) due to the presence of the hydrophobic surfaces 84. Confined between the two hydrophobic surfaces 84 in parallel as shown in FIG. 6A, liquid droplet 12 on layer 50 is directed to move along the direction of arrow 82 more reliably. In FIG. 6C, the hydrophobic surfaces 84 are arranged to be flush with the layer 50 by replacing portions of the layer 50 of FIGS. 2A-2C. In another embodiment shown in FIG. 6D, the hydrophobic surface 84 can be placed (by coating, laminating, etc.) on the layer 50. In yet another embodiment shown in FIG. 6E, layer 50 and electrodes represented by the electrodes 20 and 22 are placed on a hydrophobic substrate 88.

Figure 7A:
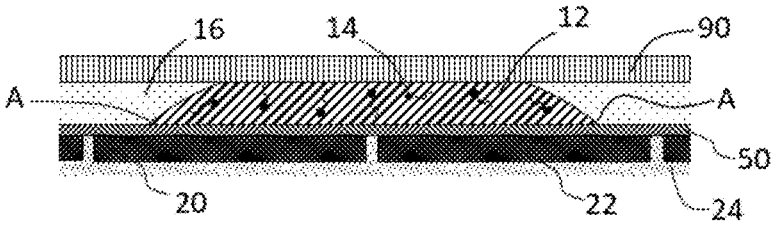
FIGS. 7A and 7B illustrate another embodiment of an electrodewetting device that is used to move a droplet on a surface using the electrodewetting effect. The device includes another substrate or surface that defines a space or gap that confines the droplet.
Figure 7B:
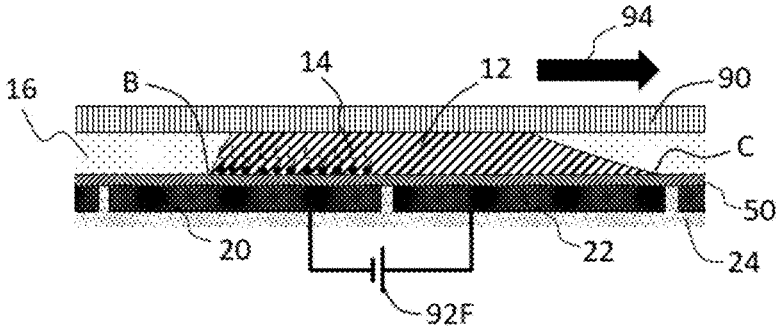
Figure 8A:
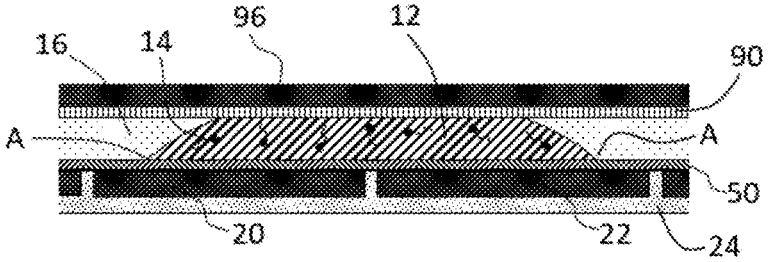
FIGS. 8A-8C illustrate another embodiment of an electrodewetting device that is used to move a droplet on a surface using the electrodewetting effect. The device includes another substrate or surface that defines a space or gap that confines by the droplet. An electrode is associated with the top substrate or surface.
Figure 8B:
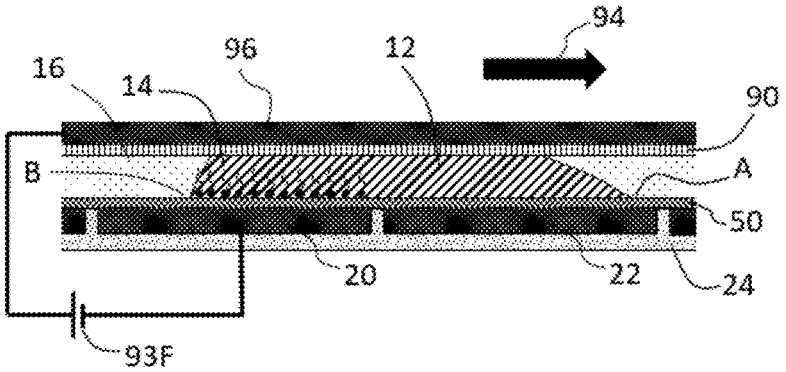
Figure 8C:
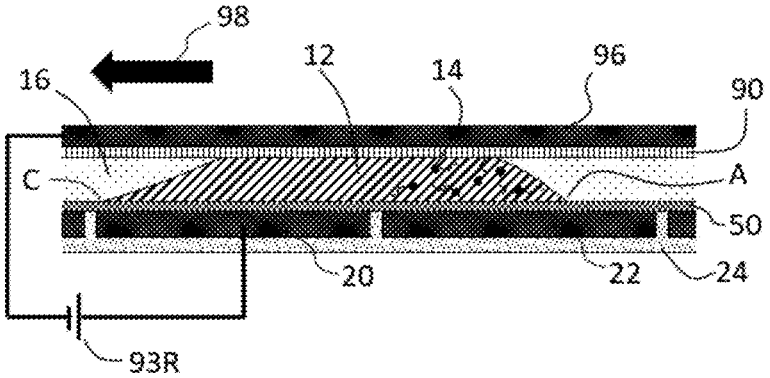

FIGS. 7A, 7B, 8A, 8B, 8C illustrate the usage of a cover plate 90, using a substrate with the electrodewetting configuration of FIGS. 2A-2C as an example. For the embodiment of FIGS. 7A and 8B, the cover plate 90 may be made of any material as its only function is to confine the liquid droplet 12. For the embodiment of FIGS. 8A-8C, the cover plate 90 may be made from an electrically conductive material covered with a less-conductive material. Other configurations can be used for the substrate, including those of FIGS. 1A-1F and 3A-3E. In FIG. 7A, a cover plate 90 is placed substantially in parallel with the substrate 24 to confine the liquid droplet 12 within the space or gap formed between the cover plate 90 and the substrate 24. When an electric bias 92F is applied between the electrodes 20 and 22 as shown in FIG. 7B, the droplet 12 moves to the direction of arrow 94, similarly to FIG. 2B. The cover plate 90 may also have an electrode 96 on or in it, as shown in FIGS. 8A-8C, to provide more options to move the liquid by electrodewetting. In FIG. 8B, when a voltage bias 93F is applied between the electrode 96 on the cover plate 90 and the electrode 20 on the substrate 24, surfactant molecules 14 are attracted on the portion of layer 50 above the electrode 20, increasing the local contact angle from A to B. As result, the liquid droplet 12 moves in the direction of arrow 94. Although not illustrated, by applying the same bias voltage 93F between the electrode 96 and the electrode 22, droplet 12 would move in the direction opposite to arrow 94. In FIG. 8C, the biasing voltage between the electrode 96 and electrode 22 is reversed to 93R. The voltage bias 93R repels the surfactant molecules 14 from the portion of layer 50 above electrode 20, decreasing the local contact angle to C. As result, the droplet 12 moves towards the direction of arrow 98. Although not illustrated, by applying the same bias voltage 93R between the electrode 96 and the electrode 22, droplet 12 would move in the direction opposite to arrow 98.

Figure 9A:
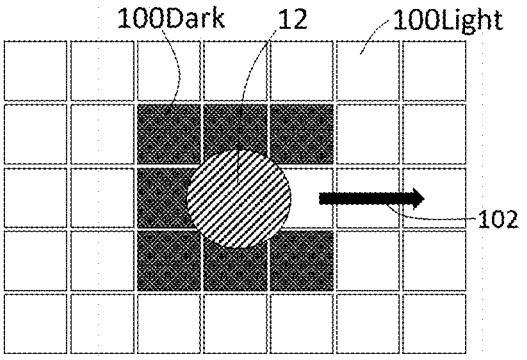
FIGS. 9A-9F illustrate a top down view of an array of electrodes along with various electrode activation schemes used to transport, split, and merge fluid droplets.
Figure 9D:
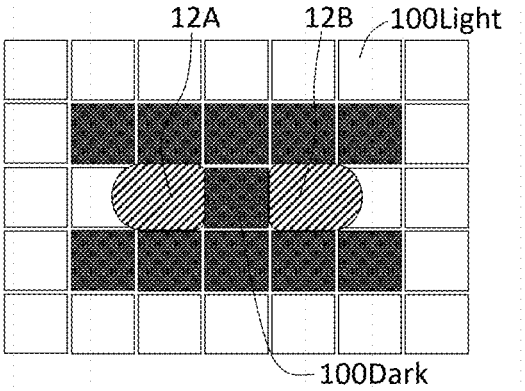
Figure 9B:
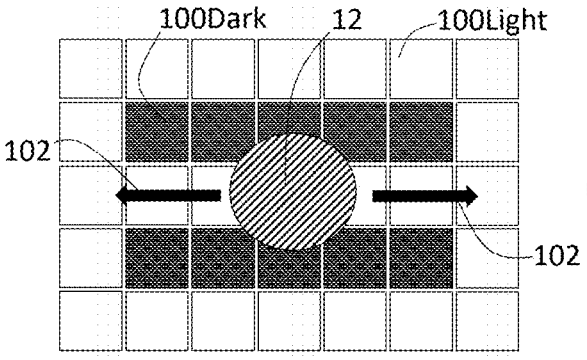
Figure 9E:
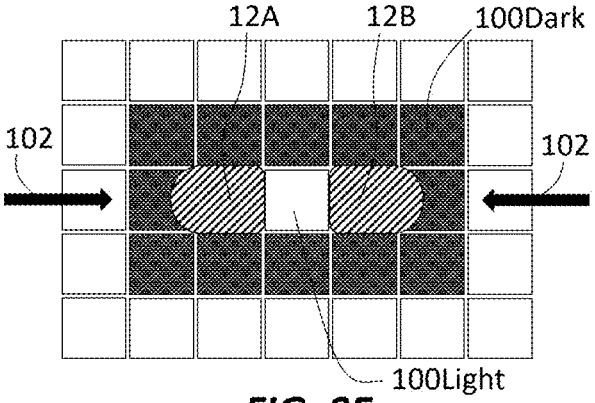
Figure 9C:
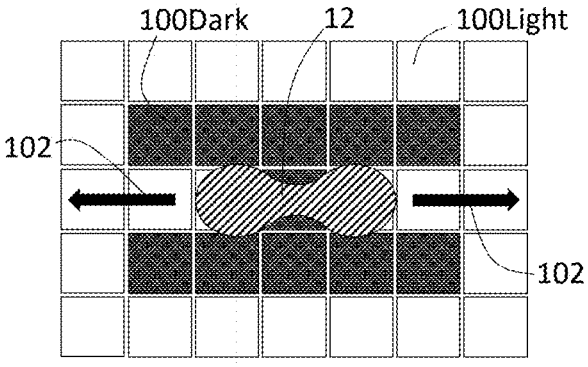
Figure 9F:
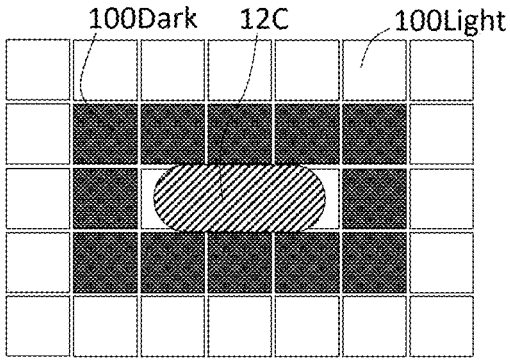

FIGS. 9A-9F illustrate the top views of electrodes 100 (designated as either 100Dark or 100Light) in various biasing arrangements and sequences to achieve important manipulations of a liquid droplet 12, which contains surfactant molecules (not illustrated). There is a voltage bias between the dark electrodes and the light (i.e., un-filled or blank) electrodes 100Light. The dark electrodes 100Dark would repel the liquid, while the light or un-filled electrodes 100Light would attract the liquid droplet 12. FIG. 9A illustrates one exemplary voltage biasing arrangement to move the liquid droplet 12 in the direction of arrow 102 (arrow 102 illustrates direction of movement of droplet 12 in FIGS. 9A-9F). Using this approach, the droplet 12 can be transported to any electrode location. FIGS. 9B-9D present an exemplary biasing sequence to split a droplet 12 into two droplets 12A, 12B. A large droplet 12 in FIG. 9B is stretched to a dumbbell shape in FIG. 9C and split into two droplets 12A, 12B as seen in FIG. 9D. The electrode 100Dark of FIG. 9D is dark and repels the droplet 12 during the splitting step of FIGS. 9C and 9D. This process of droplet splitting can further be modified to generate a droplet 12 from a large volume of the liquid although not illustrated here. FIGS. 9D-9F present an exemplary sequence to merge two droplets 12C, 12D. Starting from a separate state of FIG. 9D, two droplets 12A, 12B are pushed toward each other in FIG. 9E and merged into one droplet 12C in FIG. 9F.

Figures 10A, 10B, 10C, 10D:
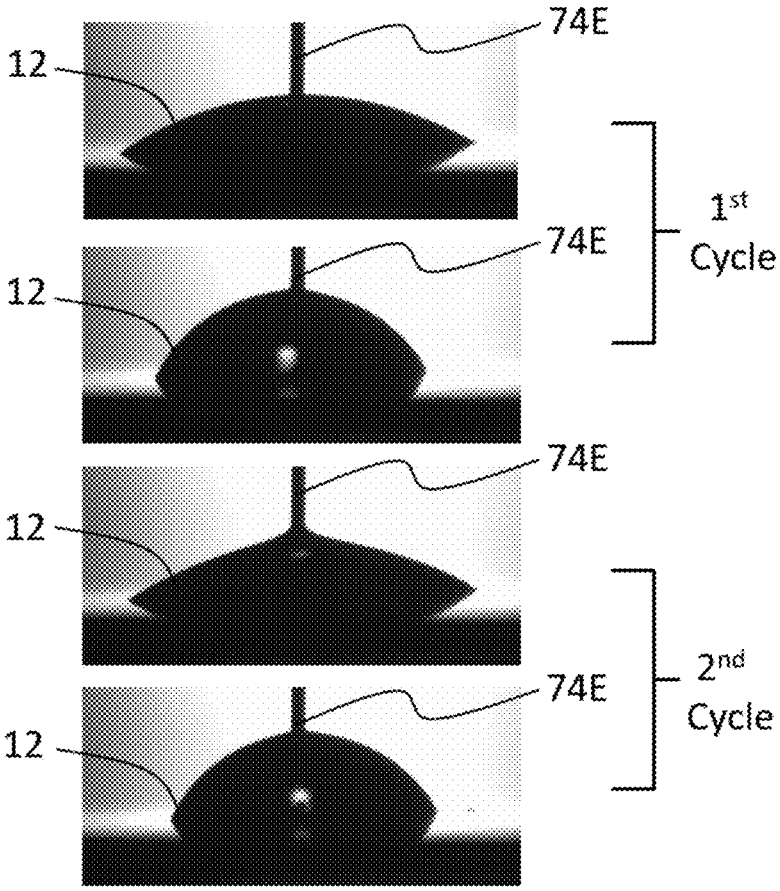
FIGS. 10A-10D illustrates a sequence of side-view photographs taken of a sessile droplet to demonstrate the reversibility of electrodewetting by showing two cycles of electrodewetting actuation. This is a modified embodiment of FIG. 5 with the central electrode replaced with an external electrode that is inserted into the droplet from the top.
Figure 11A:
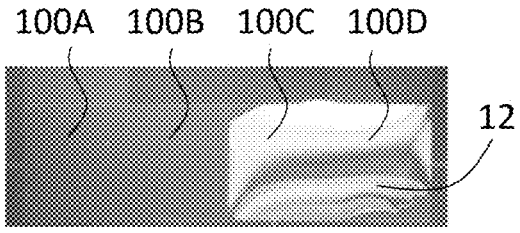
FIGS. 11A-11E illustrates a sequence of top-view photographs taken of a droplet to demonstrate droplet movement, using a device of the embodiment of FIG. 1A and following the activation scheme illustrated in FIG. 9A.
Figure 11B:
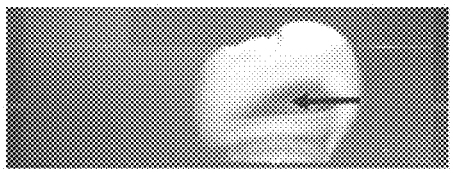
Figure 11C:
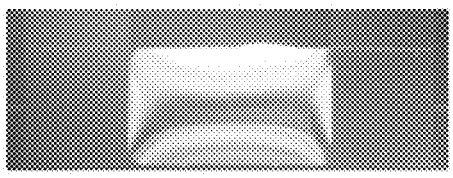
Figure 11D:
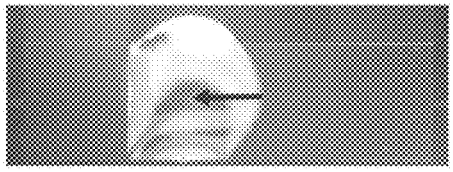
Figure 11E:
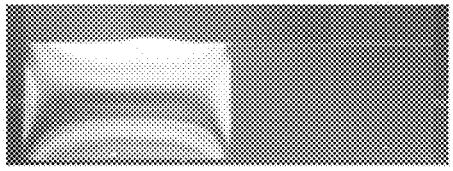

FIGS. 10A-10D demonstrate the reversibility of electrodewetting by showing two cycles of electrodewetting actuation using the configuration illustrated in FIGS. 5A-5C but with the center electrode 74 on the substrate replaced with an external electrode 74E inserted into the droplet 12 from above. FIGS. 10A and 10B show the first cycle of droplet dewetting, and FIGS. 10C and 10D show the second cycle. In FIGS. 10B and 10D, a bias voltage is applied between electrode 74E and the substrate (representing electrode 70 in the configuration of FIG. 5B) where droplet 12 sits, resulting in the increase of droplet contact angle from A to B (i.e., dewetting). In FIGS. 10A and 10C, a reverse bias voltage is applied across electrode 74E and the substrate (representing electrode 70 in the configuration of FIG. 5C), resulting in the decrease of droplet contact angle to C (i.e., wetting).

FIGS. 11A-11E illustrate photographs of a droplet 12 undergoing continuous movement over four adjacent electrodes on an electrodewetting device, achieved by sequentially connecting electrodes 100A, 100B, 100C, 100D to voltage source or ground in a fashion illustrated in FIG. 9A. The actuation sequence induces the rear end of the droplet to dewet and maintains its front end wetting. This asymmetric wetting propels the droplet 12.

Figure 12A:
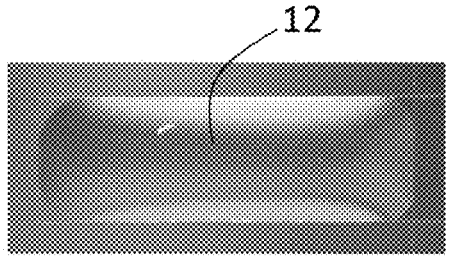
FIGS. 12A-12C illustrates a sequence of top-view photographs taken of a droplet to demonstrate droplet splitting, using a device of the embodiment of FIG. 1A and following the activation scheme illustrated in FIGS. 9B-9D.
Figure 12B:
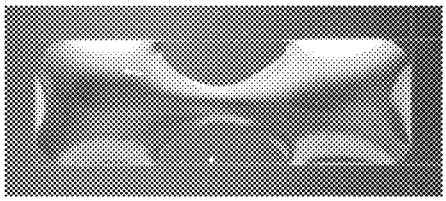
Figure 12C:
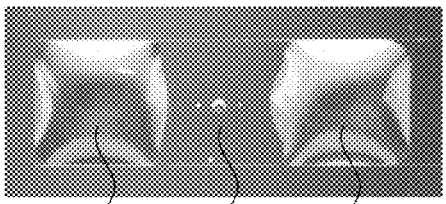

FIG. 12A-12C illustrates photographs of a droplet 12 being split over three adjacent electrodes 100E, 100F, 100G (seen in FIG. 12C) on an electrodewetting device, achieved by connecting the middle electrode 100F to ground while connecting electrodes 100E, 100G at the two shoulders to 5 V in a fashion illustrated in FIGS. 9B-9D. For a cationic surfactant 14, this configuration makes the middle electrode 100F repel the droplet 12 resulting in a split of droplet 12.

Figures 13A, 13B, 13C, 13D:
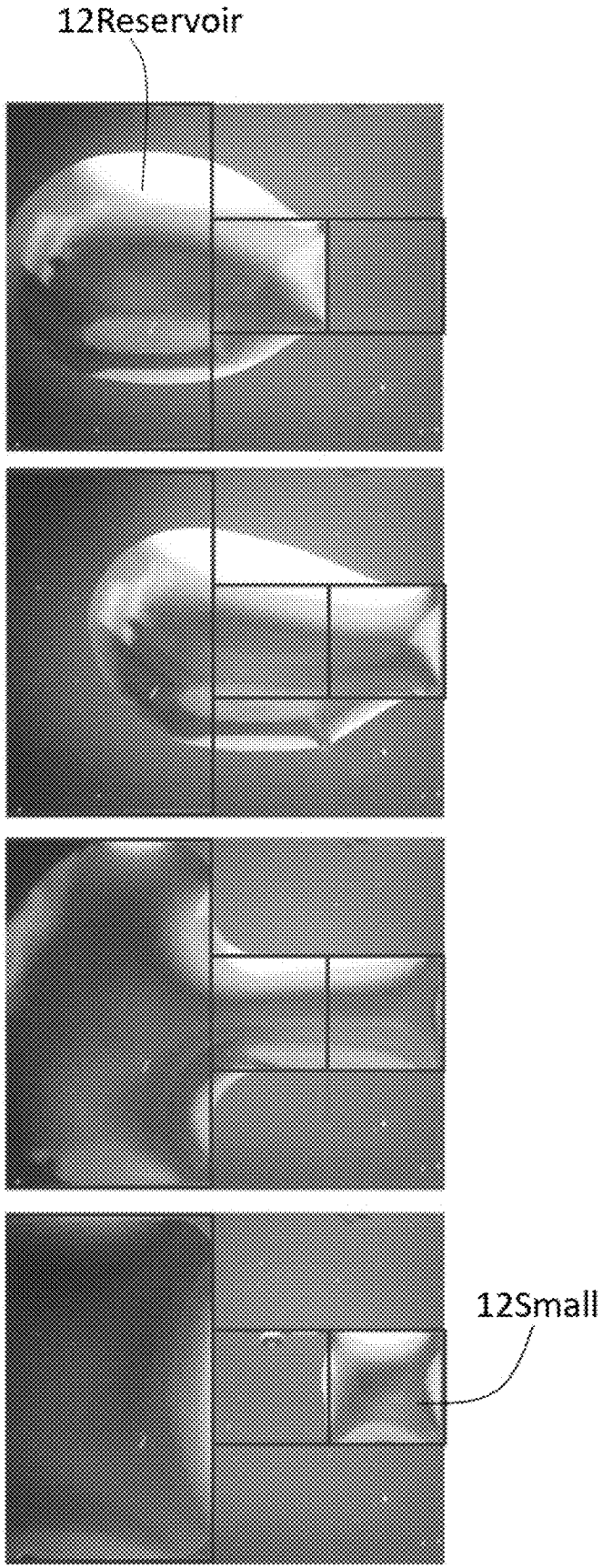
FIGS. 13A-13D illustrates a sequence of top-view photographs taken to demonstrate droplet creation by generating a small droplet from a larger droplet (or reservoir), using a device of the embodiment of FIG. 1A and following an activation scheme similar to those illustrated in FIGS. 11A-11E and FIG. 12A-12C.

FIGS. 13A-13D illustrate photographic images of the generation of a droplet 12Small from a large (reservoir) droplet 12Reservoir on an electrodewetting device, achieved by combining two operations: droplet movement (FIG. 11) and droplet splitting (FIG. 12). FIGS. 13A and 13B show a reservoir droplet 12Reservoir is moved to cover three electrodes, and FIGS. 13C and 13D show extending and splitting of the reservoir droplet 12Reservoir; leaving a droplet 12Small on one of the electrodes (shown in outline). Note that the droplet 12Small may be larger by occupying multiple electrodes, and the reservoir droplet 12Reservoir may be larger by initially occupying more than three electrodes. Furthermore, the reservoir droplet 12Reservoir may not necessarily be characterized as a discrete droplet; for example, the reservoir droplet 12Reservoir may be substantially confined in a container.

Figure 14:
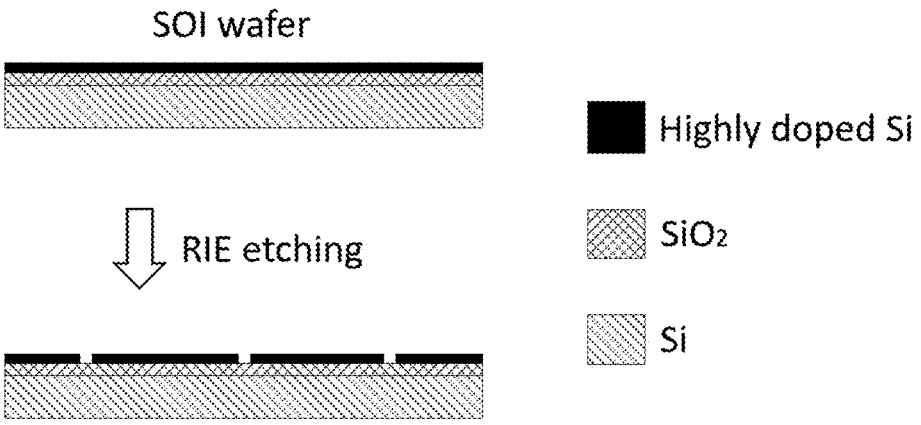
FIG. 14 illustrates an exemplary electrodewetting device fabricated by using a silicon wafer (substrate) and creating electrode patterns by doping. The surface is inherently hydrophilic, treated hydrophilic, or coated with a thin hydrophilic topcoat.
Figure 15:
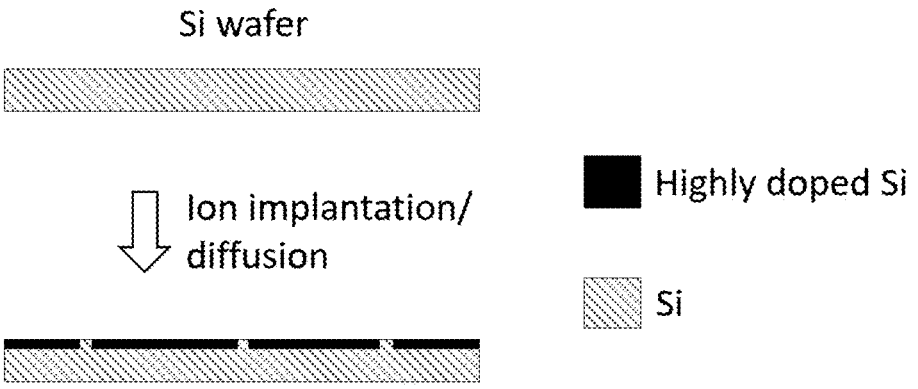
FIG. 15 illustrates an exemplary electrodewetting device fabricated by using a silicon-on-insulator (SOI) wafer and creating electrode patterns by etching. The surface is inherently hydrophilic, treated hydrophilic, or coated with a thin hydrophilic topcoat.
Figure 16:
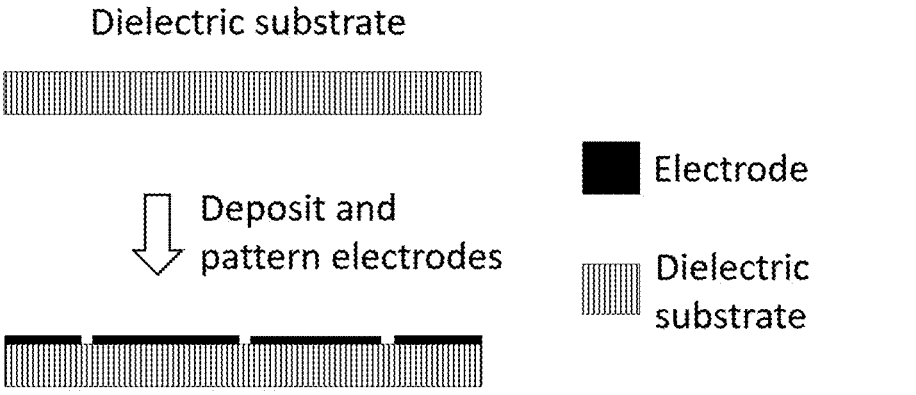
FIG. 16 illustrates an exemplary electrodewetting device fabricated by using a dielectric substrate and creating electrode patterns by depositing and patterning a conductive material. The surface is inherently hydrophilic, treated hydrophilic, or coated with a thin hydrophilic topcoat.

FIG. 14 illustrates one approach to fabricating an electrodewetting device using a conventional silicon wafer. In one embodiment, a pattern of electrodes is formed in the top of the wafer by selectively doping by ion implementation, thermal diffusion, or other known methods. The device may be further treated hydrophilic or coated with a hydrophilic material. FIG. 15 illustrates another approach to fabricate an electrodewetting device using a silicon-on-insulator (SOI) wafer. In one embodiment, a pattern of electrodes is formed by selectively etching the highly doped (i.e., conductive), thin, top silicon layer by wet etching, reactive ion etching, or other known semiconductor process. The device may be used as-is (assuming a native oxide on the top silicon), further treated hydrophilic, or coated with a hydrophilic material. FIG. 16 illustrates another approach to fabricate and electrodewetting device using a dielectric substrate, including plastic and glass. In one particular embodiment, a pattern of electrodes is formed by depositing a conductive material on the substrate, selectively etching the deposited material. The device may be further treated hydrophilic or coated with a hydrophilic material. This electrodewetting device may be made transparent by depositing a transparent electrode (e.g., indium-tin-oxide (ITO)) on a transparent substrate (e.g., glass wafer) and coating them with a transparent hydrophilic layer (e.g., $SiO_2$) by ALD, PECVD, etc.

While embodiments of the present invention have been shown and described, various modifications may be made without departing from the scope of the present invention. For example, the complementary embodiment illustrated in FIGS. 1D-1F may also be implemented in any combination of the configurations of FIGS. 3A-3E, 5A-5C, 6A-6E, 7A, 7B, 8A-8C, 9A-9F, 10A-10D, 11A-11E, 12A-12C, and 13A-13D. For another example, the specific embodiment of FIG. 1A-1C may also be implemented in any combination of the configurations of FIGS. 3A-3E, 5A-5C, 6A-6E, 7A, 7B, 8A-8C, 9A-9F, 10A-10D, 11A-11E, 12A-12C, and 13A-13D. The invention, therefore, should not be limited except to the following claims and their equivalents.

What is claimed is:

1. A method of manipulating a fluid droplet disposed on a surface located on or adjacent to a plurality of separate electrodes comprising:

providing the fluid droplet on the surface, the fluid droplet surrounded by an immiscible fluid, wherein one of the fluid droplet or the immiscible fluid contain a surfactant therein and wherein the surface under the surfactant-containing droplet or the surfactant-containing immiscible fluid is hydrophilic;

applying a voltage between two of the plurality of separate electrodes to make the contact angle between the surfactant-containing fluid droplet or the surfactant-containing immiscible fluid and the hydrophilic surface increase and utilizing the created contact-angle increase to manipulate the fluid droplet, wherein manipulation comprises movement of the fluid droplet on the surface or changing a shape of the fluid droplet.

2. The method of claim 1, wherein the surfactant is located in the fluid droplet.

3. The method of claim 1, wherein the surfactant is located in the immiscible fluid.

4. The method of claim 1, wherein the surface comprises an electrically resistive material.

5. The method of claim 1, wherein the surface comprises an electrically insulating material.

6. The method of claim 1, wherein the surface comprises a glass or plastic.

7. The method of claim 1, wherein the surfactant comprises a cationic surfactant.

8. The method of claim 7, wherein the surfactant comprises one of dodecyl trimethylammonium bromide (DTAB), cetyltrimethylammonium bromide (CTAB), and tetradecyltrimethylammonium bromide (TTAB).

9. The method of claim 1, wherein the surfactant comprises an anionic surfactant.

10. The method of claim 9, wherein the surfactant comprises one of sodium dodecyl sulfate (SDS), 1-hexadecanesulfonic acid sodium salt (HDSAS), sodium tetradecyl sulfate (STS), and sodium decyl sulfate (S10S).

11. The method of claim 1, wherein the hydrophilic surface is confined between two hydrophobic surfaces in parallel.

12. The method of claim 1, wherein the plurality of separate electrodes comprise concentrically-shaped electrodes.

13. The method of claim 1, wherein the surface comprises a first electrode, a second electrode, and a third electrode, wherein the second electrode is located between the first electrode and the third electrode and wherein the fluid droplet completely covers the second electrode and contains a surfactant therein;

applying a voltage between the second electrode and either the first electrode or the third electrode to displace the fluid droplet across the surface.

14. The method of claim 1, wherein a second surface is spaced apart from the surface holding the fluid droplet, wherein the fluid droplet is located between the respective surfaces.

15. The method of claim 14, wherein the second surface has one or more electrodes disposed therein or located adjacent thereto and the method further comprises applying a voltage between electrode(s) of the surface holding the droplet and the electrode(s) of the second surface.

16. A method of manipulating a fluid droplet disposed on a hydrophilic surface located on or adjacent to a plurality of separate electrodes comprising:

providing the fluid droplet on the hydrophilic surface, the fluid droplet surrounded by an immiscible fluid, wherein one of the fluid droplet or the immiscible fluid contain a surfactant therein; and applying a sequence of voltages between different electrodes of the plurality of separate electrodes to perform one or more of: moving the fluid droplet, merging the fluid droplet with another fluid droplet, splitting the fluid droplet, and creating a fluid droplet from a larger volume of the fluid.

* * * * *